US008579650B2

(12) United States Patent
Keswani

(10) Patent No.: US 8,579,650 B2
(45) Date of Patent: Nov. 12, 2013

(54) ELECTRICAL DISCONNECT WITH PUSH-IN CONNECTORS HAVING A BUSBAR

(75) Inventor: Sushil N. Keswani, Sycamore, IL (US)

(73) Assignee: Ideal Industries, Inc., Sycamore, IL (US)

( * ) Notice: Subject to any disclaimer, the term of this patent is extended or adjusted under 35 U.S.C. 154(b) by 52 days.

(21) Appl. No.: 13/291,709

(22) Filed: Nov. 8, 2011

(65) Prior Publication Data

US 2013/0115797 A1 May 9, 2013

(51) Int. Cl.
*H01R 4/24* (2006.01)

(52) U.S. Cl.
USPC ..... 439/441

(58) Field of Classification Search
USPC ..... 439/441, 835, 444, 660, 732, 439, 291, 439/346, 289, 284.293, 357, 595, 681
See application file for complete search history.

(56) References Cited

U.S. PATENT DOCUMENTS

| | | | | |
|---|---|---|---|---|
| 3,605,050 | A | 9/1971 | Goldman et al. | |
| 3,648,219 | A | 3/1972 | Goldman | |
| 4,701,000 | A * | 10/1987 | Suprono | 439/423 |
| 6,499,428 | B1 | 12/2002 | Prindle | |
| D542,222 | S | 5/2007 | Wakefield et al. | |
| 7,384,319 | B2 * | 6/2008 | Kirstein et al. | 439/839 |
| D574,772 | S | 8/2008 | Sutter | |
| D574,773 | S | 8/2008 | Sutter | |
| 7,473,123 | B1 | 1/2009 | Breen, IV et al. | |
| 7,527,509 | B1 | 5/2009 | Bethurum et al. | |
| 7,628,681 | B2 | 12/2009 | Wang et al. | |
| 7,702,400 | B2 | 4/2010 | Marchetti | |
| 7,722,384 | B2 * | 5/2010 | Breen, IV | 439/441 |
| 7,727,002 | B2 | 6/2010 | Bethurum et al. | |
| 7,731,522 | B2 | 6/2010 | Keswani et al. | |
| 7,753,718 | B2 | 7/2010 | Bethurum et al. | |
| 7,771,217 | B2 | 8/2010 | Bethurum et al. | |
| 7,887,353 | B2 | 2/2011 | Bethurum et al. | |
| 7,988,481 | B2 | 8/2011 | Bethurum et al. | |
| 2008/0311802 | A1 * | 12/2008 | Keswani et al. | 439/863 |
| 2009/0215321 | A1 | 8/2009 | Hughes | |
| 2009/0227132 | A1 * | 9/2009 | Bethurum et al. | 439/153 |
| 2011/0171843 | A1 | 7/2011 | Casses et al. | |

OTHER PUBLICATIONS

ISA/US, Int. Search Report and Written Opinion of the Int. Searching Authority issued on Int. Appln. No. PCT/US12/61445, 11 pages.

* cited by examiner

*Primary Examiner* — Renee Luebke
*Assistant Examiner* — Harshad Patel
(74) *Attorney, Agent, or Firm* — Greenberg Traurig, LLP

(57) ABSTRACT

An electrical disconnect includes a male housing having an enclosed contact and a female housing similarly having an enclosed contact. The contact in at least one of the housings includes a busbar to electrically couple a plurality of wires. Upon joining the disconnect, the contacts in the two housing engage to form as releasable connection. By including a busbar, multiple conductors in one of the housings may be coupled to a single conductor in the second housing. Additionally, by disconnecting the housing, each load in the circuit may be simultaneously interrupted as desired.

19 Claims, 8 Drawing Sheets

ELECTRICAL DISCONNECT WITH PUSH-IN CONNECTORS HAVING A BUSBAR

FIELD OF THE DISCLOSURE

The present disclosure relates generally to electrical disconnects and more particularly, to an electrical disconnect with push-in connectors having a busbar.

BACKGROUND OF RELATED ART

The present disclosure is directed towards a disconnect for an electrical circuit. In general, disconnects employing a plug and socket combination provide a convenient and safe way to replace and/or wire circuit elements. In one known disconnect, U.S. Pat. No. 7,771,217, incorporated herein by reference in its entirety, a disconnect allowing for the replacement of a circuit, such as a non-residential fluorescent light circuit is provided. In one example, the described disconnect includes a male and female housing compliant with the National Electrical Code (NEC) section 410.73(G) which addresses the problem of replacing ballasts for non-residential fluorescent fixtures in live circuits. In particular, the example disconnect allows for the simultaneous removal of all conductors of the ballast from the source of supply. While the known disconnect is sufficient for connecting and disconnecting conductors on a one-to-one basis, the disconnect may not be easily used to connect multiple connectors to a single connector, such as for example, in a daisy-chain design.

Alternatively, a known push-in-connector, of the type described in U.S. Pat. No. 7,731,552, incorporated herein by reference in its entirety, may be utilized to connect multiple conductors together through the use of a busbar. The described connector includes a closed housing having multiple push-in connectors that electrically isolate the conductors from the surrounding elements, while providing good connections between the conductors. The push-in connector described, however, does not allow for the easy removal of the conductors from the housing once inserted, nor does the connector allow for the simultaneous disconnect of the conductors as may be required by code.

Accordingly, there is an identifiable need for a disconnect that provides for a safe and efficient ability to connect multiple conductors to a single source conductor such as, for example, in a daisy chain fashion. The present disclosure provides one such disconnect.

DETAILED DESCRIPTION

The following description of example electrical disconnects is not intended to limit the scope of the description to the precise forms detailed herein. Instead the following description is intended to be illustrative so that others may follow its teachings.

Figure 1A:
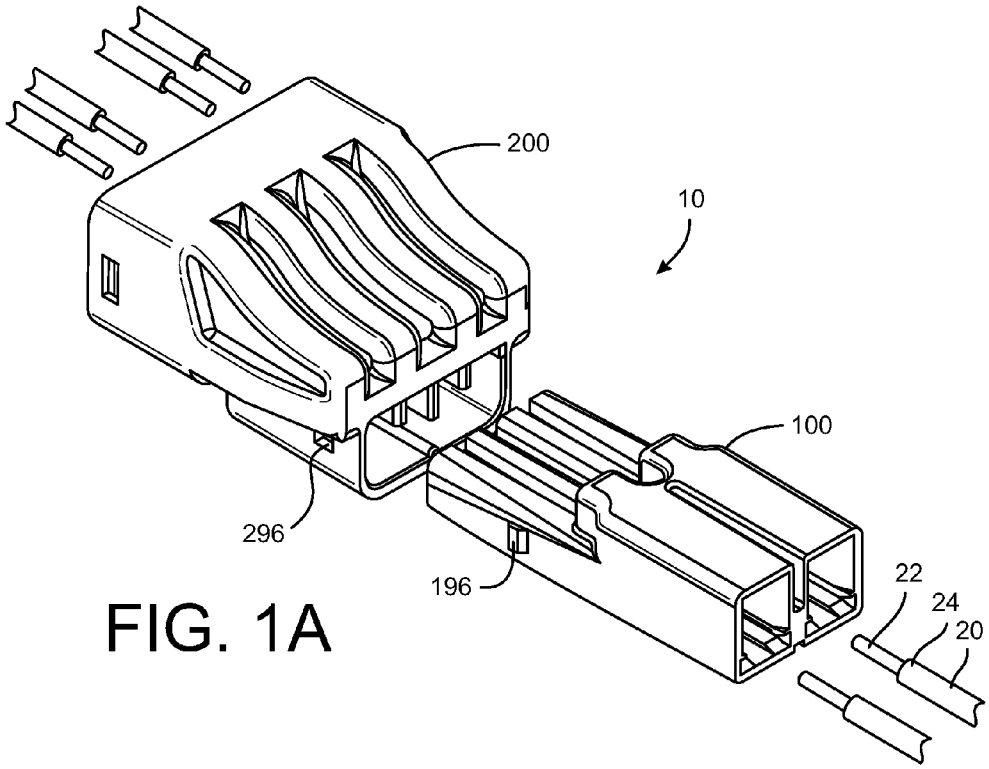
FIG. 1A is a front perspective view of an example electrical disconnect of showing the disconnect prior to joining.
Figure 1B:
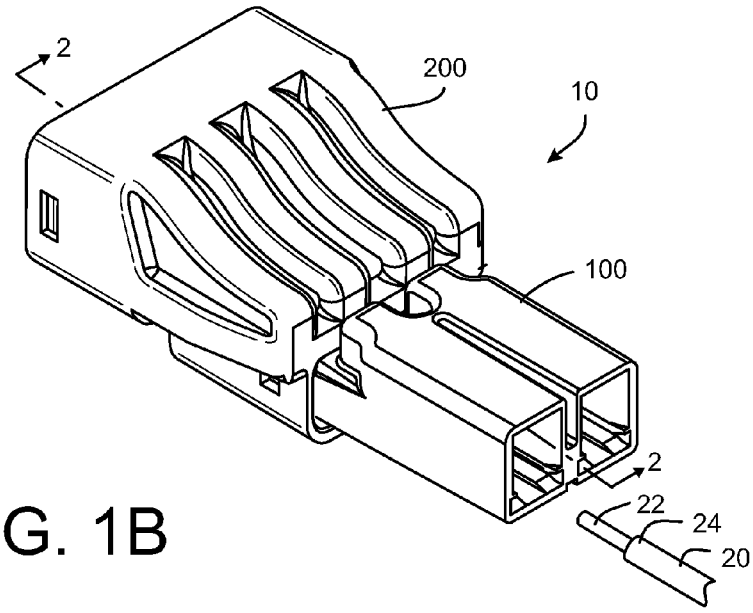
FIG. 1B is a front perspective view of the example electrical disconnect of FIG. 1A showing the disconnect after joining.

Referring now to FIGS. 1A and 1B, an example electrical disconnect 10 is generally shown. The example electrical disconnect 10 shows a push-in wire connector having a 2-pole design for connecting two sets of conductors in, for example, a daisy chain, but it will be appreciated that the disconnect could be designed for use with any number of poles and/or combinations of poles as desired.

The example disconnect 10 has a first and second housing, such as, for example, a male housing 100 and a female housing 200. The housings 100, 200 may be formed of any suitable material, including, for example, a conductive and/or non-conductive material as desired. In this example, the male housing 100 may be at least partially inserted into the female housing 200 to form an electrical path between multiple conductors, such as wires. In the example illustrated in FIG. 1A, the disconnect 10 is shown prior to joining, while in FIG. 1B, the disconnect 10 is illustrated in a joined, or connected configuration.

Figure 2:
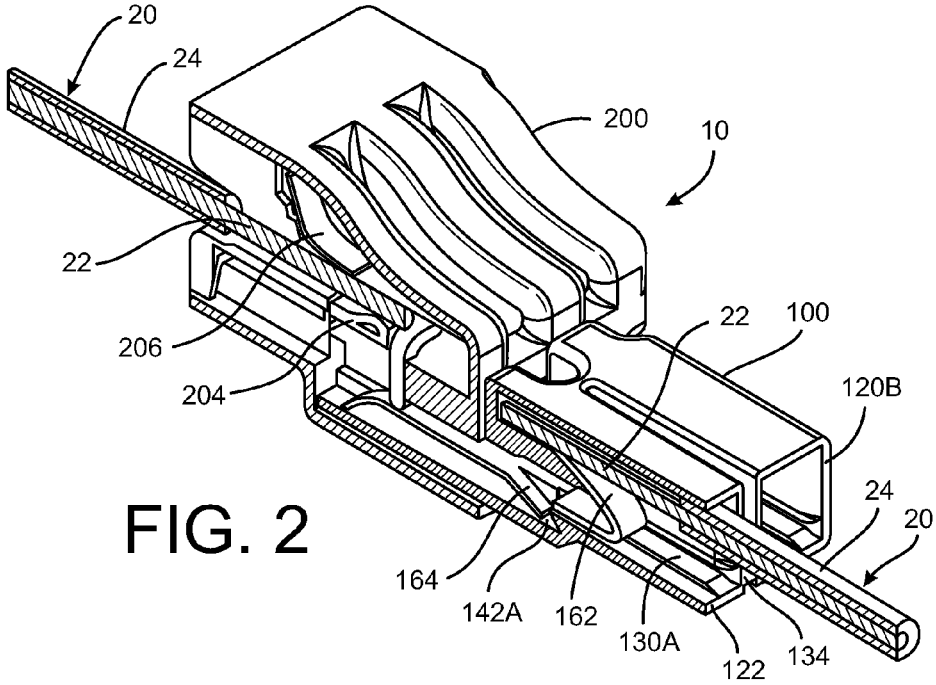
FIG. 2 is a front perspective view of a section taken along line 2-2 of FIG. 1B.
Figure 3:
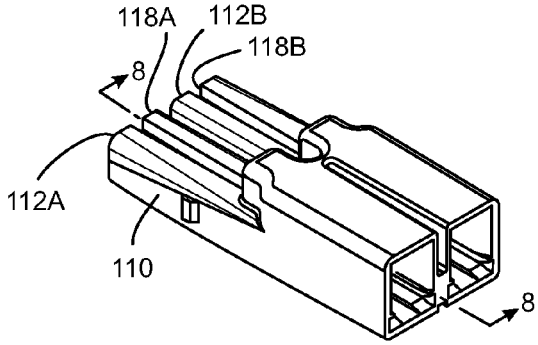
FIG. 3 is a front perspective view of the example male housing of the electrical disconnect of FIG. 1A.

Referring to FIG. 2, which is a cross-sectional perspective view of the example joined disconnect 10 of FIG. 1B, inside the male housing 100 is a pair of male contacts 102, one of which is shown. The example contacts 102, 202 may be completely disposed within the housing 100, 200, respectively, or may be at least partially exposed outside the housing as desired. Similarly, inside the female housing is a pair of female contacts 202, one of which is shown. As will be described in greater detail below, in this example, each female contact 202 includes a busbar 204 supported on a spring element 206. The designation of the contacts 102 and 202 as male and female in this instance derives more from the housing in which they are mounted (male housing 100 and female housing 200, respectively) than any function of the contacts themselves. This is because each pair of male and female contacts engages in a side-by-side relation, rather than one being received within the other.

As will be understood by one of ordinary skill in the art, the male and female housing 100, 200, and the male and female contacts 102, 202 are each designed to electrically couple to at least one wire 20 (see FIG. 1B). As will be appreciated, in order to connect the wire 20, an insulation portion 24, if present, is stripped or otherwise removed to expose a conductor portion 22 of the wire. The wire 20 may then be inserted into the respective housing to form a connection with the respective contact. The wire 20 may extend to a power supply, ground, and/or other load device as desired. With the example disconnect 10 the destinations of any wires connected to the contacts 102, 202 are not an issue, beyond understood electrical techniques, as either housing 100, 200 may connect to either side of a circuit.

Figure 4:
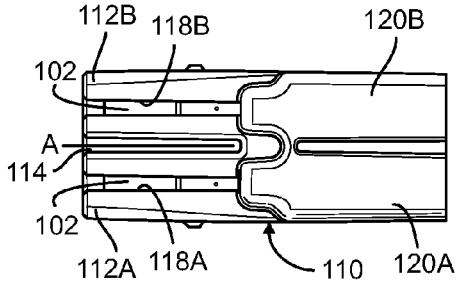
FIG. 4 is a top plan view of the example male housing of FIG. 3.
Figure 5:
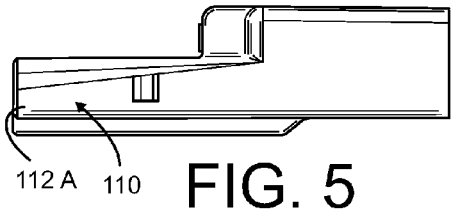
FIG. 5 is a side elevational view of the example male housing of FIG. 3.
Figure 6:
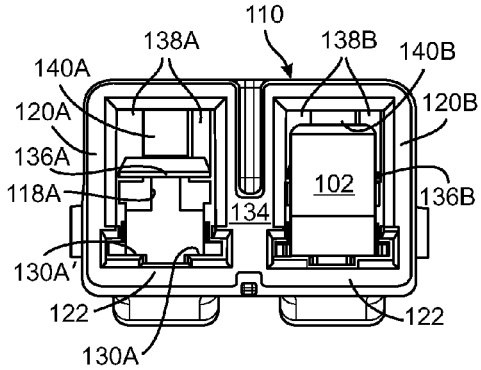
FIG. 6 is a front elevational view of the example male housing of FIG. 3, showing one example male contact.
Figure 7:
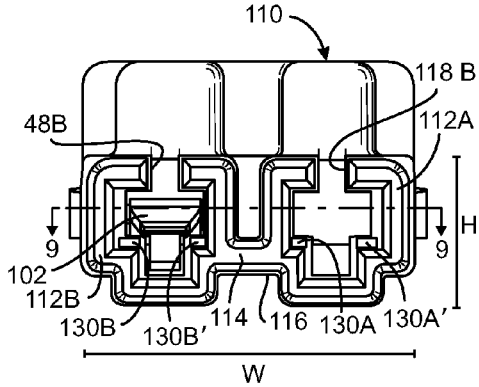
FIG. 7 is a rear elevational view of the example male contact of FIG. 6.

FIGS. 3-9 illustrate the exterior and interior features of the example male housing 100. In particular, the example male housing 100 defines a longitudinal axis A as seen in FIG. 4. The male housing 100 has a shell 110. At one end, the shell 110 is defined by a pair of generally four-sided compartments 112A, 112B. The compartments 112A, 112B are joined near their lower, inside corners by a web 114 (FIG. 7). A groove 116 is defined underneath the web 114 and between the compartments 112A, 112B. Slots 118A, 118B are cut in the upper walls of the compartments 112A, 112B. The exterior height H of the compartments 112A, 112B, and their combined widths W are such that the male shell 110 can be received in the female housing 200. At another end, the shell 110 has a pair of wire receptacle boxes 120A, 120B including a retainer plate 122.

FIGS. 6-9 illustrate the interior features of the male shell 110. In the illustrated example, the male contact 102 typically located within the compartments 112A, 120A has been removed for ease of illustration. The removed male contact 102 can be seen in FIG. 4, however.

Figure 9:
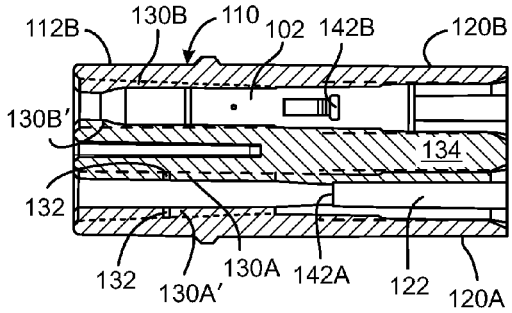
FIG. 9 is section taken along line 9-9 of FIG. 7.
Figure 8:
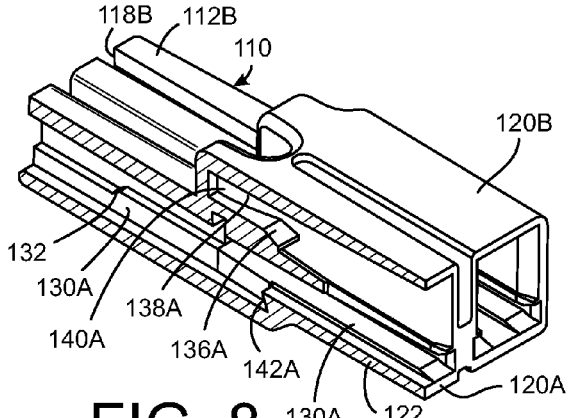
FIG. 8 is a front perspective view of a section taken along line 8-8 of FIG. 3.
Figure 12:
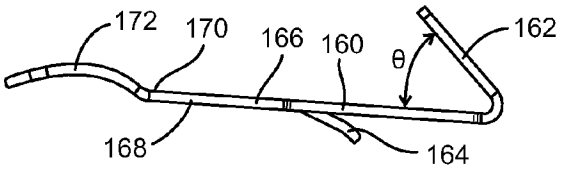
FIG. 12 is a side elevational view of the example male contact of FIG. 10.
Figure 13:
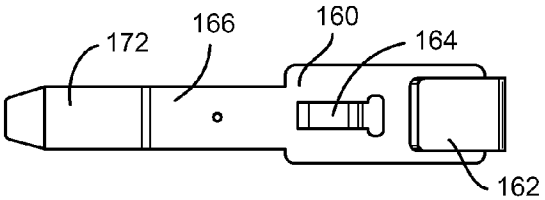
FIG. 13 is a top plan view of the example male contact of FIG. 10

In the illustrated example of FIGS. 7, 8, and 9 the lower interior corners of each compartment 112A, 112B includes a pair of support rails. One pair of support rails is shown at 130A, 130A' and the other pair of support rails is shown at 130B, 130B'. Each support rail 130A, 130A', 130B, 130B' has a short step 132 which gives the rails a greater height at the interior of the shell 110 compared to the end. As will be explained in more detail below, the support rails engage lateral edges of a support surface of the male contacts 102. The interior of the shell 110 is open to and joins to the interior of the female housing 200 when the connector 10 is joined.

FIGS. 6, 8, and 9 illustrate the interior features of the example wire receptacle boxes 120A, 120B. The wire receptacle boxes 120A, 120B are generally an enclosed structure having outer walls connected to the retainer plate 122. The inner walls of the boxes 120A, 120B merge with one another at a central spine 134. Horizontal spring stops 136A, 136B extend across the interior of the boxes 120A, 120B. The spring stops 136A, 136B cooperate with pairs of inwardly convergent sloping surfaces, such as guide walls 138A, 138B to direct incoming conductors into a seat 140A, 140B defined by the wire receptacle boxes and the guide walls.

In operation, the seats 140A, 140B constrain a conductor to a confined area which may be of particular importance for some conductors, such as for example, with stranded conductors because the confined seats prevent the conductors from flattening out or splaying, which if it occurred could cause a reduction in the holding force of the push-in connector elements. The spring stops 136A, 136B may also limit deflection of the spring fingers of the contact elements 102. That is, it is desired that the example disconnect 10 be usable with wires of various gauges, including for example, wire gauges from 16 AWG to 18 AWG, although the disconnect may be scaled for any wire gauge including, for example 12 AWG, as desired. With the larger wire sizes it may be possible to cause plastic deformation of the spring fingers during insertion of the wire, and thus the spring stops 136A, 136B are disposed in the path of spring finger movement to limit flexure of the spring finger to an amount no more than their elastic limit.

The example retainer plate 122 is best seen in FIGS. 2, 8, and 9. The example plate 122 closes the bottom side of the shell 110 and also serves to lock the electrical contacts 102 within the housing. For instance, in the present example, each of the retaining plates is provided with a notch 142A, 142B to engage a corresponding tab 164 of the contact 102 to prevent the contact 102 from being pulled out of the housing 100. In this instance, incorporation of the retainer plate 122 in the interior of the housing 100 alleviates the need to provide a separate cap or cover for closing the housing and holding the contacts 102 therein.

FIGS. 10-13 illustrate details of the example male contacts 102. As illustrated, each example contact 102 is made of a suitable, electrically conductive material, such as for example, a 510, 511, or 519 phosphorous bronze, brass, spring temper, having a thickness of about 0.002 to 0.020 inches, and in this instance 0.016 inches. The contact 102 has a central plate 160. At one end of the plate 160, the contact 102 has a resilient connector such as, for example, a spring finger 162 folded back on the central plate 160 at an angle θ of about 39° to 45°, although the angle θ may be any suitable angle as desired. The spring finger 162 serves as a push-in connector element that mechanically and electrically engages a conductor such as the wire 20 pushed into the housing 100. The tab 164 is formed in the central plate 168 and extends downwardly therefrom. As noted above, the tab 164 engages one of the notches 142A, 142B to prevent the contact 102 from being pulled from the housing 100 once fully inserted thereinto.

At an end opposite to the spring finger 162, there is an arm 166. The arm 166 has a support surface 168 and a mating surface 170 on the opposite side from the support surface 168. A contact portion, such as a rounded arc 172 is formed at or near the end of the arm 166 to resiliently engage with the female contact 202 as will be described.

Figure 14:
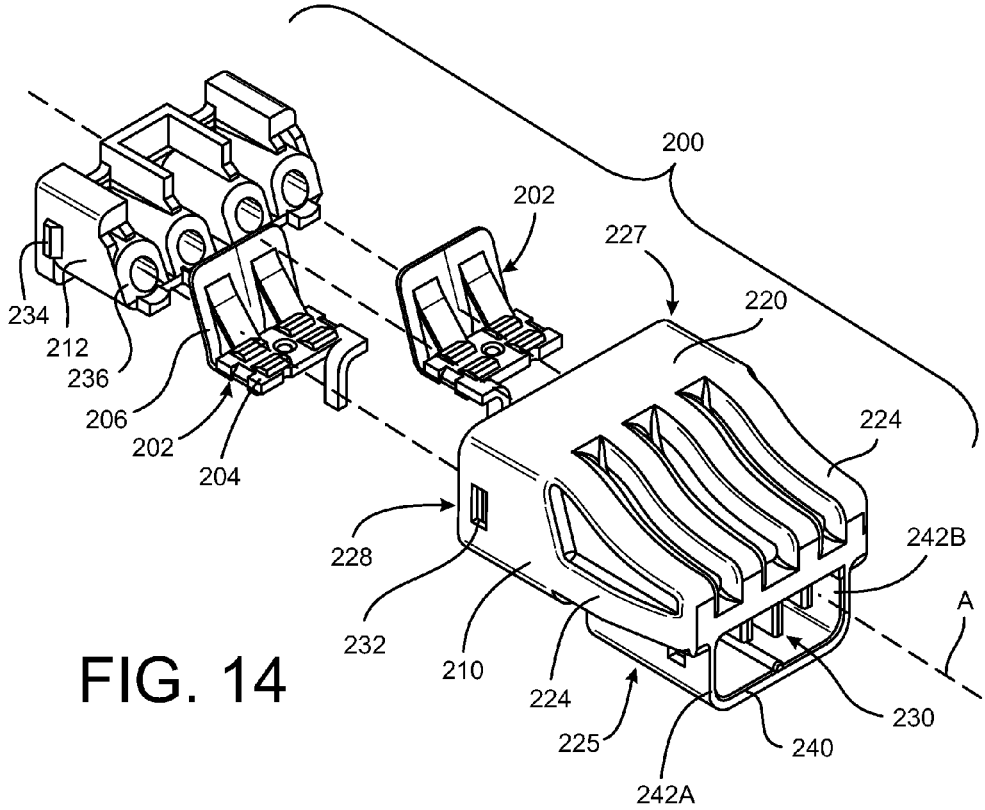
FIG. 14 is an exploded perspective view of the example female housing of the electrical disconnect of FIG. 1A.
Figure 15:
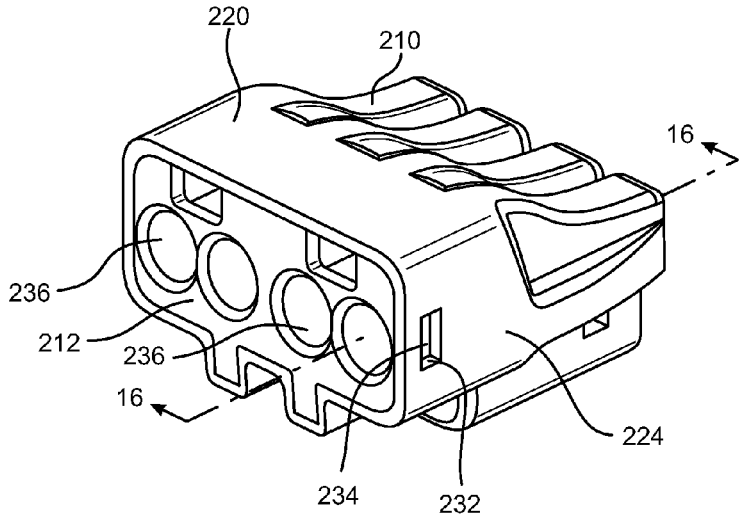
FIG. 15 is a rear perspective view of the example female housing of FIG. 14.
Figure 16:
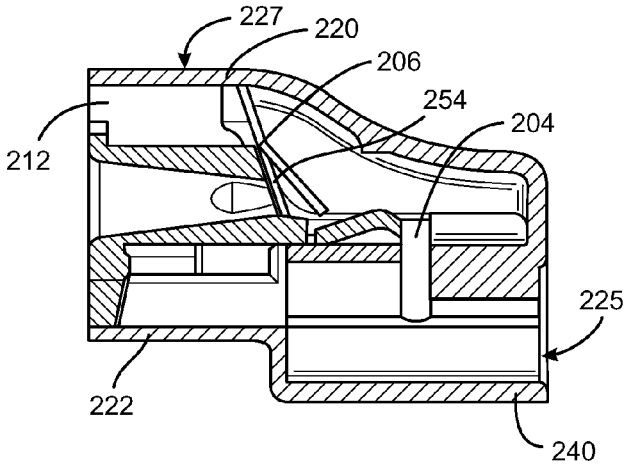
FIG. 16 is a side elevational view of a section taken along line 16-16 of FIG. 15.
Figure 17:
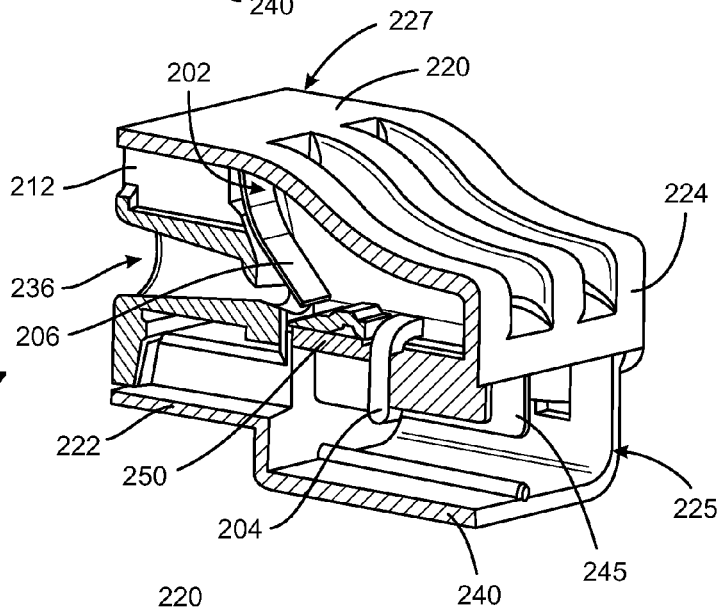
FIG. 17 is a front perspective view of the section taken along line 16-16 of FIG. 15.
Figure 18:
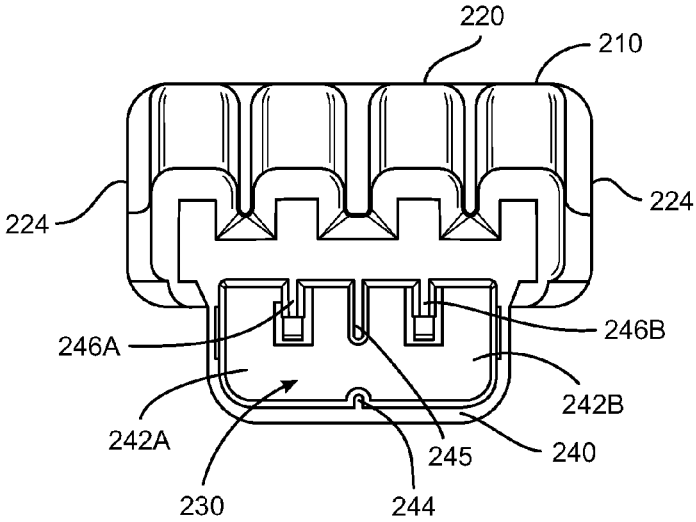
FIG. 18 is a front elevational view of the example female housing of FIG. 14.

FIGS. 14-19B illustrate the example female housing 200 of the example disconnect 10. As best shown in FIG. 14, which is an exploded view of the example housing 200, the housing 200 is formed in two pieces and includes a shell 210 and a push-in connector cap 212. Together, the shell 210 and the cap 212 enclose two of the female contacts 202. The housing 200 defines a longitudinal axis A and is generally defined by a top wall 220 and a bottom wall 222, which arc connected by two side walls 224. The shell 210 generally includes a disconnect portion 225 and a wire connect portion 227 each defining an open interior. The wire connect portion 227 defines an open end 228 to receive the cap 212, while the disconnect portion 225 defines a second open end 230 to receive the male housing 100. The interior of the disconnect portion 225 is open to and joins the interior of the wire connect portion 227.

Regarding the wire connect portion 227, the side walls 224 each define an aperture 232 proximate to the open end 228, one of which can be seen in FIG. 14. The apertures 232 engage corresponding hooks 234 which protrude from the sides of the cap 212 to retain the cap 212 in the shell 210. Additionally, as seen, the example cap 212 has a plurality of ports 236 extending through the cap 212. These ports 236 provide access to the interior of the wire connect portion 227 through the open end 228 and to the retained female contacts 202.

Figure 19A:
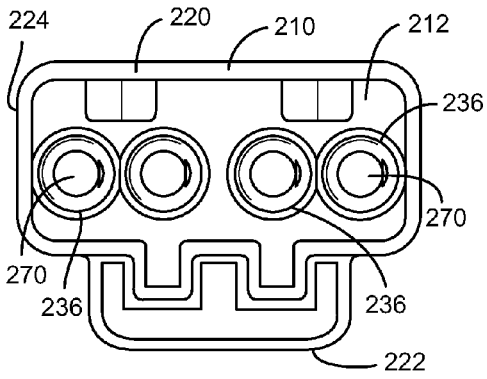
FIG. 19A is a rear elevational view of the example female housing of FIG. 14.
Figure 19B:
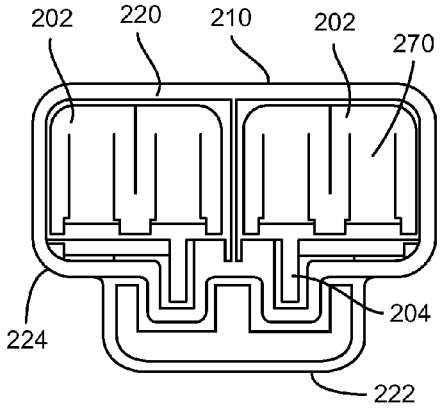
FIG. 19B is a rear elevational view of the example female housing of FIG. 14 showing the cover removed.

The disconnect portion 225, meanwhile includes an offset extension 240. The extension 240 defines a pair of receptacle boxes 242A, 242B sized to receive the compartments 112A, 1128 of the male housing 100. In this example, there is a longitudinal rib 244 extending upwardly from a bottom wall of the extension 240 and a second longitudinal rib 245 extending downwardly from a top wall 220. Similarly, two support rails 246A, 246B depend from the top wall 220. The support rails 246A, 246B are configured to engage the slots 118A, 118B cut in the upper walls of the compartments 112A, 112B. As noted above, the interior of the extension 240 is open to and joins the interior of wire connect portion 227. As can be seen in FIG. 19B, the female contact 202 is seated within the interior of the wire connect portion 227 such that the busbar 204 extends into the disconnect portion 225 as will herein described.

Figure 22:
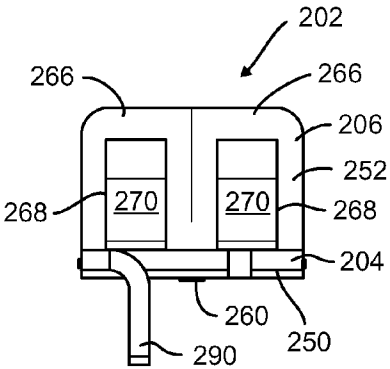
FIG. 22 is a front elevational view of the example female contact of FIG. 20.
Figure 11:
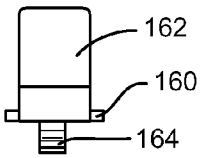
FIG. 11 is an elevational view of the example male contact of FIG. 10.
Figure 21:
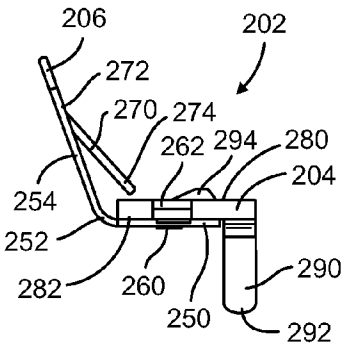
FIG. 21 is a side elevational view of the example female contact of FIG. 20.
Figure 10:
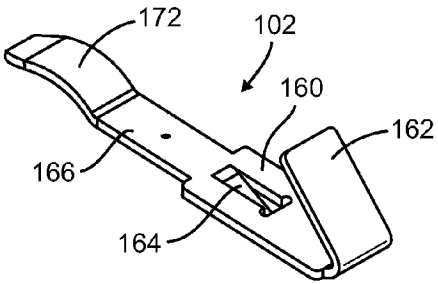
FIG. 10 is a perspective view of the example male contact of the male housing of FIG. 3.
Figure 20:
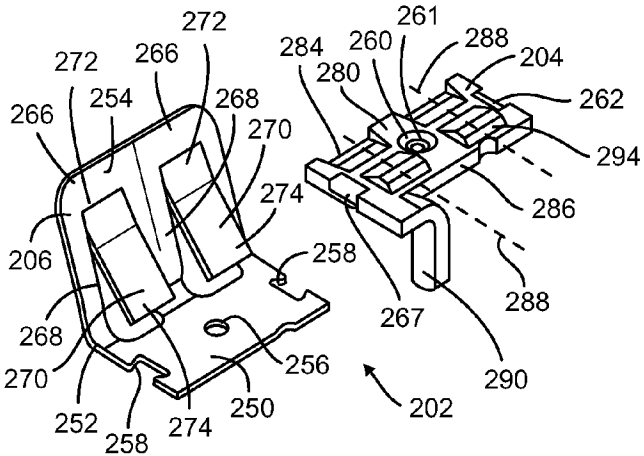
FIG. 20 is an exploded perspective view of the example female contact of the female housing of FIG. 14.

Turning to FIGS. 20-22 an example of the female contact 202 is shown. The example contact 202 includes the busbar 204 supported on the spring member 206. The spring member includes a foot 250 joined at a fold line 252 to an upstanding leg 254. The foot 250 may also define an aperture 256 and/or slots 258 for receiving a rivet 260 and/or tabs 262 of the busbar 204. In this example, the upstanding leg 254 is a sheet divided into two sections 266. The sections 266 extend from a top edge of the leg 254 and end at the fold line 252. Each section 266 includes a U-shaped slit 268 which defines a resilient connector such as, for example, a spring finger 270. The spring finger 270 is integrally connected to its section 266 at one end 272 and has a free end 274 at its opposite end. The example spring fingers 270 are bent out of the plane of the upstanding leg 254. In at least one example, the free end 274 may be further angled relative to the remainder of the finger 270 to provide an optimum angle for gripping a wire inserted under the spring finger 270. In this example, the spring member 206 is formed of a resilient metal such as stainless steel, but it will be appreciated that the spring member 206 may be formed of any suitable material including any non-conductive and/or conductive material as desired. Additionally, while illustrated as being formed as two separate elements, the busbar 204 and the spring member 206 may be integrally formed as desired.

Returning briefly to FIGS. 16 and 17, it can be seen that the wire connector portion 227 of the female housing 200 supports the foot 250 of the spring member 206. Similarly, an interior portion of the cap 212 engages the upstanding leg 254. The cap 212 cooperates with the interior of the housing 200 to restrain the contact 202 in the housing 200. As illustrated in FIGS. 19A and 19B, one of the spring fingers 270 is opposite each of the cap ports 236 so that a wire inserted into the cap 212 will encounter the spring finger 270 and move it upwardly as the wire enters the case. The free end 274 of the spring finger 270 will press on the wire, preventing it from pulling out of the housing 200 and pushing it into firm engagement with the busbar 204.

Returning now to FIGS. 20-22, details of the example busbar 204 will be described. In this example, the busbar 204 is a generally rectangular member made of a conductive material, such as for example, tin-plated copper, other copper alloys, e.g., brass, phosphor bronze or the like. The busbar 204 defines a thickness T between a top face 280 and a bottom face 282. In the illustrated example the top face 280 happens to be exposed to incoming wires while the bottom face 282 rests on the foot 250 of the spring element 206, but it could be otherwise. The busbar 206 further defines an entry edge 284, an exit edge 286, and at least two wire-crossing axes 288 extending from the entry edge 284 to the exit edge 286. As used herein the entry edge will be considered the edge of the busbar 204 first crossed by a conductor entering the housing 200 and the exit edge will be considered the edge of the busbar 204 last crossed by an entering conductor. The wire-crossing axis 288 is the location where a conductor will generally lie, given the construction of the housing 200 and the busbar's position therein.

At noted above, the busbar 204 is attached to the foot 250 of the spring member 206 by means of a rivet 260 and/or slots 262 extending into the aperture 256 and/or the slots 258 of the foot 250. The rivet 260 and/or the slots 258 may be formed by any suitable process, including by upsetting a portion of the busbar 204, leaving a depression 261 in the top face 280.

As shown in FIGS. 20-22, the busbar 204 further includes a downwardly extending tab 290 proximate to exit edge 286. The tab 290 extends the busbar 204 into the disconnect portion 225 of the housing 205 and facilitates electrical contact with the male contact 102 when the male housing 100 is fully inserted into the female housing 200 as illustrated in FIG. 2. The tab 290 may include a rounded end 292 to engage and/or otherwise contact the rounded arc 172 of the male contact 102.

As shown in FIGS. 20-21, the top face 280 of the busbar 204 has at least one wire-engaging protrusion 294 extending above the top face 280 on each of the wire-crossing axes 288. The protrusions 294 may be formed by any suitable process, including for example, coining the busbar 204. It can be appreciated that the protrusion 294 forms a path for an inserted conductor to traverse over the top face 280 of the busbar 204. This configuration helps the spring finger 270 retain the inserted conductor in the housing 200.

Having described the individual components of the disconnect 10, attention can now be focused on FIGS. 1A, 1B, and 2, which illustrate assembly of the disconnect 10 as follows. In this example, the male contacts 102 are pushed into the male housing 100 through the openings at rear end of the wire receptacle boxes 120A, 120B. The first contact 102 is arranged so that the lateral edges of its support surface 160 are adjacent to and supported by the support rails 130A, 130A'. Similarly, the second contact 102 is arranged so that the lateral edges of its support surface 160 are adjacent to and supported by the support rails 130B, 130B'. As the contacts 102 are inserted the tab 164 will snap beyond the notch 142A, 142B. The engagement of the tab 164 with the notches 142A, 142B prevents the contacts 102 from pulling out of the housing 100, even though there is no cap or plate at the entry to the wire receptacle boxes. The recess defined by the housing 100 affords some space into which the arc 172 can flex during connection of the two housings 100, 200. Installation of the female contacts 202 is similarly performed, except there the female contacts 202 are retained within the female housing 200 by the cap 212 as described above. Once the contacts 102, 202 are inserted, the disconnect 10 is ready for use.

The use, operation, and function of the example disconnect 10 are as follows. To use the disconnect 10, stripped wires 20 are pushed into the female housing 200. The stripped conductors 22 fit through the ports 236 formed in the cap 212 and slide under the spring fingers 270 of the female contacts 202. As noted above, the fingers 270 flex to receive the conductors 22 and to resiliency urge the conductors 22 into electrical engagement with the busbars 206. Thus, in this example, two of the inserted wires 20 will be electrically coupled through the busbar 204. This permits so-called daisy-chaining of the wires 20. Because any withdrawal of the wires 20 would tend to make the fingers 270 rotate toward the busbar 204, the contacts 102 are self-locking. Once the wires 20 are thus installed, the female housing 200 is ready for use.

Stripped wires 20 are similarly installed into the male housing 100. For example, the conductor 22 is pushed through the open end of the wire receptacle boxes 120A, 120B and then over the spring fingers 162. Once again the spring fingers 162 flex to receive the conductors 22 but they will not permit easy withdrawal of the wires 22. The end of the conductors 22 slide into the seats 140A, 140B as directed by the spring fingers 162 and the guide walls 138A, 138B.

With both housings 100, 200 now fitted to their respective wires, the disconnect 10 is ready to be joined. To join the disconnect, the male housing 100 is pressed into the open end 230 of the female housing 200 along the commonly defined longitudinal axis A. For instance, in this example, the axis A of each of the male housing 100 and the female housing 200 are aligned. The rib 244 of the female housing 200 fits into the groove 116 of the male housing 100 allowing the male housing 100 to move into the female housing 200. As it does so, the support rails 246A, 246B of the female housing 200 fit into the slots 118A, 118B in the top of the male housing 100. The tab 290 of the female contact 202 slides beyond at least a portion of the arc 172 of the male contact 102 causing the arc 172 to flex. Once the male housing 100 is fully inserted into the female housing 200 (see FIG. 2), the resilience of the male contact 102 forces the arc 172 into solid electrical contact with the tab 290 of the female contact 202. The support rails are arranged to maintain physical engagement with most of the arm portions of the contacts. This assures the contacts can not flex away from solid engagement with one another despite the contacts being surrounded by the male and female housings.

Still further, it will be appreciated that in this example, the tab 290 of the female contact 202 slides beyond the apex of the arc 172 once the male housing 100 is fully inserted into the female housing 200. In this manner, the resilient force of the arc 172 against the tab 290 may tend to urge the male housing 100 into the female housing 200. Similarly, to withdraw the male housing 100 from the female housing 200, the resilient force will need to be overcome, and dependent upon the force applied, the force required to withdraw the male housing 100 may be increased significantly.

The example female housing 200 defines an aperture 296 on each side proximate to the open end 230, one of which can be seen in FIG. 1A. The apertures 296 engage corresponding hooks 196 which protrude from the sides of the male housing 100 to further retain the joined male housing 100 in the female housing 200. Additionally, in the illustrated example, the exterior dimensions of the compartments 112A, 112*b* increase slightly moving away from the end towards the middle of the shell 110. In this manner, the shell 110 may create an increasingly secure interference fit between the exterior of the shell 110 and the interior of the female housing 200.

It will be appreciated that the connection of the male housing 100, with the female housing 200, while secure for their intended purposes, may be broken such that the male housing 100 may be removed from the female housing 200. This may be desirable in any instance, including for example, where it may be desirable to interrupt the electrical circuit created by the joining of the disconnect 10.

As described above, because each of the example female contacts 202 has a pair of spring fingers 270 coupled by a busbar 204, more than one wire can be electrically coupled without having to insert multiple wires into a particular spring finger 270. This permits so-called daisy-chaining of wires, without over-loading (either electrically and/or physically) a particular spring finger 270, and similarly allowing multiple disconnects to be utilized on a single power circuit.

Figure 23:
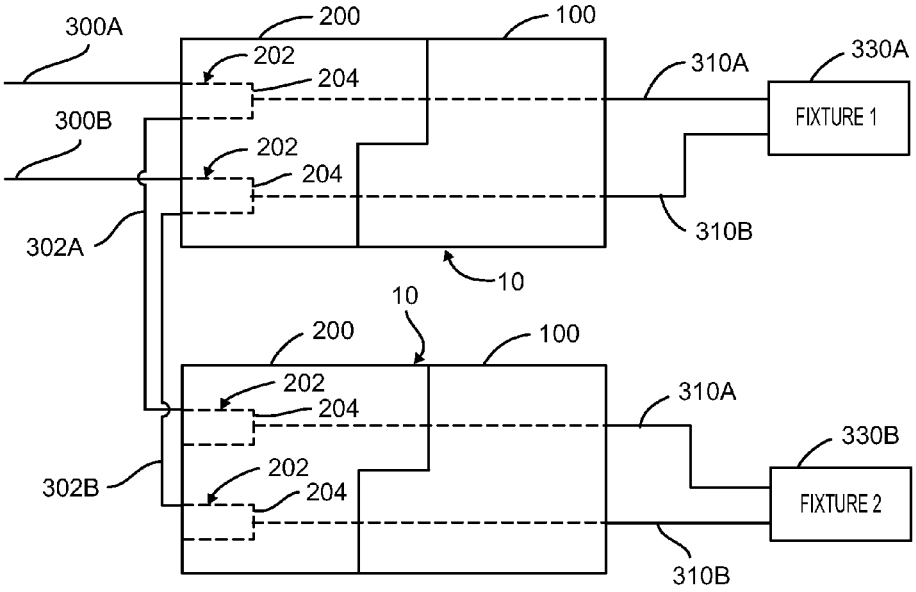
FIG. 23 is a circuit diagram showing one example application of the disconnect of FIGS. 1A and 1B.

For example, as illustrated in FIG. 23, a single power circuit may be daisy-chained to two disconnects 10. In this example, a hot wire 300A and a neutral wire 300B may be inserted into one of the respective contact pairs in the first female housing 200. A daisy-chained hot wire 302A may extend from the female contact 202 electrically coupled to the hot wire 300A to the corresponding contact 202 in the second female housing 200. Similarly, a daisy-chained neutral wire 302B may extend from the female contact 202 electrically coupled to the neutral wire 300B to the corresponding contact 202 in the second female housing 200. In each disconnect 100, a load hot wire 310A and a load neutral wire 310B extend from the male housing 200 to the fixture 330A, 330B, respectively. Thus, each fixture 330A, 330B may be powered through a single load connector.

In will be understood that in another example, the disconnect 10 may be reversed, and the power circuit may be connected to the male housing 100, allowing multiple fixtures to be connected to the female housing side. For example, a single power circuit could supply hot and neutral to multiple fixtures attached to the female housing. In this instance, a hot wire and a neutral wire may be inserted into respective sides of the male housing, and pairs of hot wires may extend from the hot side of the female housing, electrically coupled by the busbar, to each of the fixtures, respectively. Similarly, a pair of neutral wires may extend from the neutral side of the female housing, electrically coupled by the busbar, to each fixture. Thus, each fixture may be powered through a single load connector.

It will be appreciated that similar connections may be made to additional fixtures as desired, and it will be understood that the construction and number of connections within the housings 100, 200, may vary as desired. For example, in at least one example, the male housing 100 may include a third contact 100, and the female housing may be similarly modified to include a third contact 202, such as, for example, a grounding contact. In still another example, the female housing may include a busbar adapted to electrically couple three or more spring fingers such that additionally wires may be electrically coupled as desired. Still further, it will be appreciated that the size and/or construction material of the described housing and contact may vary as necessary to meet desired design characteristics.

Still further, while the example disconnect 10 is described as maintaining a single wire in each contact finger it will be appreciated that in some instances, their may be multiple wires retained by at least one finger as desired. For example, in some instances, a single fixture may include multiple load circuits, such as it the case in a fluorescent light fixture with multiple ballasts, and therefore, multiple wires may be inserted into a single finger.

Figure 24:
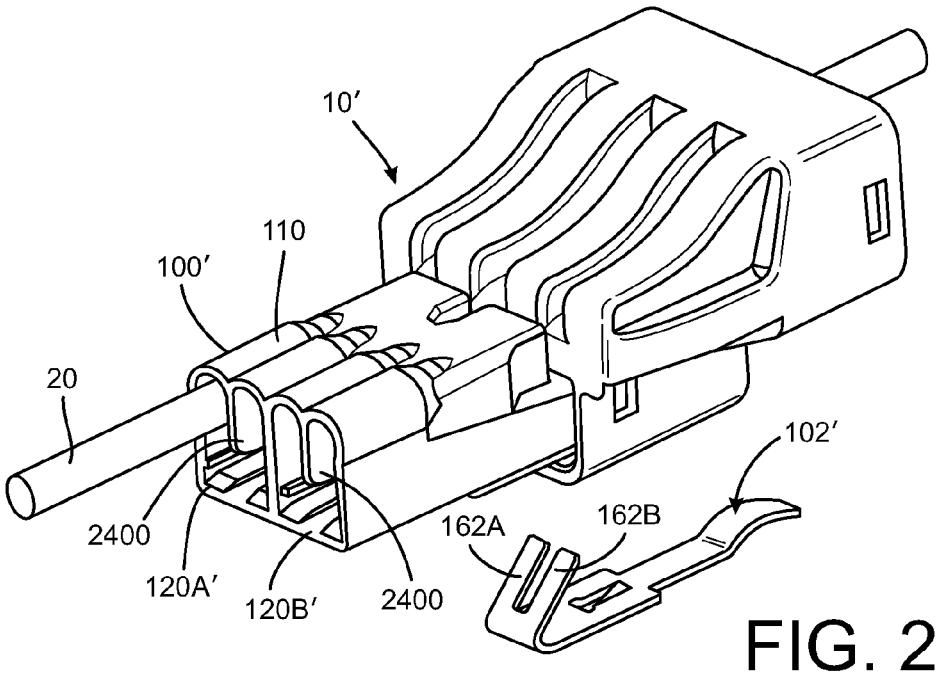
FIG. 24 is a front perspective view of another example disconnect.

As illustrated in FIG. 24, in at least one additional example, a disconnect 10', and more particularly a male housing 100' may define wire receptacle boxes 120A', 120B' including at least one bifurcation 2400 in the upper wall of the housing 100', thus bisecting the wire receptacle boxes 120A', 120B', and allowing for insertion of multiple wires 20 into each wire receptacle box. In this instance, a modified male contact 102' (shown removed from the housing 100') may be provided having a modified spring finger similarly bifurcated into a first spring finger 162A and a second spring finger 162B. In this example, multiple wires may be retained in each side of the male housing 100'.

Figure 25:
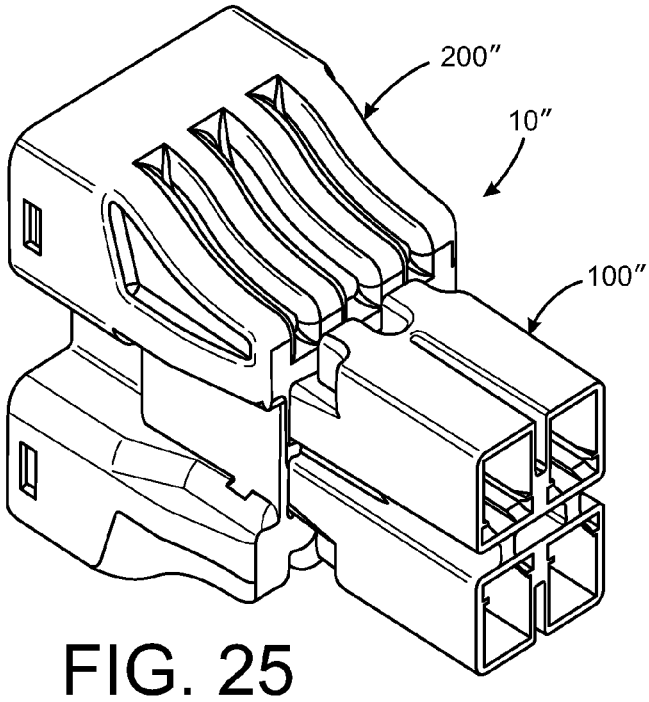
FIG. 25 is a front perspective view of yet another example disconnect.

In yet another example, illustrated in FIG. 25, a disconnect 10" includes an expanded male housing 100" and an expanded female housing 200" having a 4-pole design. In this example, the housings 100" and 200" essentially mirror the housings 100, 200, respectively, providing for multiple connection options. As previously noted, multiple variations on the number of contacts provided in each housing may be provided as desired without departing from the teaching of the present disclosure.

Furthermore, it will be understood that throughout this description, relative designations such as "top", "bottom", "front", "rear", "down", "up", etc, are used herein for reference purposes only, as there is nothing inherent in the orientation of the example disconnects that would make a particular orientation necessary.

Although certain examples have been described herein, the scope of coverage of this patent is trot limited thereto. On the contrary, this patent covers all methods, apparatus, and articles of manufacture fairly falling within the scope of the appended claims either literally or under the doctrine of equivalents.

I claim:

1. An electrical disconnect comprising:

a first non-electrically-conductive housing having a first electrically-conductive contact comprising a push-in type connector formed on a first end of the first contact; and a second non-electrically-conductive housing having a second electrically-conductive contact, the second electrically-conductive contact having at least two push-in type connectors electrically coupled through a busbar, and each of the push-in type connectors formed on a first end of the second contact, the second housing defining a first interior space at least partially enclosing the first end of the second contact having the push-in type connectors, and a second interior space adapted to receive at least a portion of the first housing such that a protrusion formed on at least one of the second contact or the busbar extends from the first interior space into the second interior space, wherein the first and second housings are releasably engageable, and wherein during engagement of the first and second housings, the protrusion electrically engages and causes to flex a resilient contact portion found on the first contact to electrically couple the first contact to both of the push-in type connectors of the second contact.

2. An electrical disconnect as defined in claim 1, wherein the protrusion extends substantially perpendicular from the busbar.

3. An electrical disconnect as defined in claim 1, wherein the contact portion is a rounded arc.

4. An electrical disconnect as defined in claim 3, wherein the rounded arc further comprises an apex.

5. An electrical disconnect as defined in claim 4, wherein the apex travels beyond the protrusion when the first and second housing are fully engaged.

6. An electrical disconnect as defined in claim 1, wherein the protrusion tangentially contacts the contact portion.

7. An electrical disconnect as defined in claim 1, wherein the protrusion extends from the busbar.

8. An electrical disconnect as defined in claim 7, wherein the protrusion extends substantially perpendicular from the busbar.

9. An electrical disconnect as defined in claim 7, wherein the protrusion is integrally formed with the busbar.

10. An electrical disconnect as defined in claim 1, wherein the protrusion further comprises a cammed surface to contact and cause to flex the resilient contact portion.

11. An electrical disconnect as defined in claim 1, wherein at least one of the first and second housings encloses the respective contact mounted therein.

12. An electrical connector, comprising:

a first non-electrically-conductive housing carrying at least one first flexible, electrically-conductive push-in type contact having a first end configured to receive and grip an electrical conductor, and a second end having a contact portion;

a second non-electrically-conductive housing carrying a second flexible, electrically-conductive contact having at least two connectors at a first end of the second contact, each of the connectors configured to receive and grip an electrical conductor, and each of the connectors being electrically coupled through a busbar; and an electrically conductive protrusion extending from a second end of the second contact, the second housing defining a first interior space enclosing at least a portion of the second contact and a second interior space adapted to receive at least a portion of the first housing, wherein the protrusion extends from the first interior space into the second interior space, wherein the first and second housings are operable configured to be releasable connected and when connected, to bring the protrusion into electrical contact with the resilient contact portion of the first contact, wherein the resilient contact portion of the first contact flexes as the first and second housings are moved into engagement with each other.

13. An electrical connector as defined in claim 12, wherein the protrusion extends substantially perpendicular from the second end of the second contact.

14. An electrical connector as defined in claim 12, wherein the resilient contact portion forms a rounded arc.

15. An electrical connector as defined in claim 12, wherein at least a portion of the resilient contact portion travels beyond the protrusion when the first and second housing are fully engaged.

16. An electrical connector as defined in claim 12, wherein the protrusion tangentially contacts the resilient contact portion.

17. An electrical connector as defined in claim 12, wherein the protrusion extends from the busbar.

18. An electrical connector as defined in claim 17, wherein the protrusion extends substantially perpendicular from the busbar.

19. An electrical connector as defined in claim 12, wherein the protrusion further comprises a cammed surface to contact and cause to flex the resilient contact portion.

* * * * *